US010134500B2

(12) United States Patent
Ikeya

(10) Patent No.: US 10,134,500 B2
(45) Date of Patent: Nov. 20, 2018

(54) CRYSTAL DIRECTION CONTROL OF ALLOYED ALUMINUM WIRE, ALLOYED ALUMINUM ELECTRIC WIRE, AND WIRE HARNESS USING SAME

(71) Applicant: Yazaki Corporation, Tokyo (JP)

(72) Inventor: Hayato Ikeya, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 15/785,959

(22) Filed: Oct. 17, 2017

(65) Prior Publication Data

US 2018/0114606 A1 Apr. 26, 2018

(30) Foreign Application Priority Data

Oct. 25, 2016 (JP) ..... 2016-209004

(51) Int. Cl.
*H01B 1/02* (2006.01)
*H01B 7/00* (2006.01)
*H01B 7/02* (2006.01)

(52) U.S. Cl.
CPC ..... *H01B 1/023* (2013.01); *H01B 7/0045* (2013.01); *H01B 7/02* (2013.01)

(58) Field of Classification Search
None
See application file for complete search history.

(56) References Cited

U.S. PATENT DOCUMENTS 3,663,216 A * 5/1972 Hunsicker ..... C22C 21/00 148/417
3,697,260 A * 10/1972 Hunsicker ..... C22C 21/00 148/439
9,650,706 B2 * 5/2017 Sekiya ..... C22F 1/047
9,773,580 B2 * 9/2017 Yoshida ..... H01B 1/023
9,779,849 B2 * 10/2017 In ..... H01B 1/023
9,870,841 B2 * 1/2018 Yoshida ..... H01B 1/023
9,899,118 B2 * 2/2018 Yoshida ..... H01B 1/023
9,899,119 B2 * 2/2018 Yoshida ..... H01B 1/023
2008/0299001 A1 * 12/2008 Langlais ..... B22D 17/007 420/532

(Continued)

FOREIGN PATENT DOCUMENTS

JP 2015-124409 A 7/2015
JP 2016-108612 A 6/2016
JP 2016108612 * 6/2016

*Primary Examiner* — Dimary Lopez Cruz
*Assistant Examiner* — Muhammed Azam
(74) *Attorney, Agent, or Firm* — Sughrue Mion, PLLC

(57) ABSTRACT

An aluminum wire 10 has a composition containing at least one element of Fe: 0 to 2.0 mass %, Mg: 0 to 1.0 mass %, Zr: 0 to 0.5 mass %, Si: 0 to 1.2 mass %, or Ni: 0 to 0.3 mass %, with the remainder being composed of aluminum and unavoidable impurities. In a cross section 15 perpendicular to the longitudinal direction 11 of the aluminum wire, the surface area proportion of component crystals for which the angle 14 between the longitudinal direction and the <111> direction of the crystal is 10° or less, relative to the total surface area of the cross section, is 50% or greater, and the surface area proportion of component crystals for which the angle 14 between the longitudinal direction and the <111> direction of the crystal is 20° or less, relative to the total surface area of the cross section, is 85% or greater.

4 Claims, 5 Drawing Sheets

(56) References Cited

U.S. PATENT DOCUMENTS

| | | | | |
|---|---|---|---|---|
| 2011/0079427 | A1* | 4/2011 | Powale | H01B 3/427 174/72 A |
| 2013/0264115 | A1* | 10/2013 | Kobayashi | H01B 1/023 174/72 A |
| 2014/0261908 | A1* | 9/2014 | Seki | C22C 1/026 148/551 |
| 2015/0213913 | A1* | 7/2015 | Yoshida | C22C 21/02 174/74 R |
| 2015/0213914 | A1* | 7/2015 | Sekiya | C22C 21/02 174/74 R |
| 2015/0235729 | A1* | 8/2015 | Yoshida | H01B 1/023 174/74 R |
| 2015/0279499 | A1* | 10/2015 | Sekiya | C22C 21/02 174/72 A |
| 2016/0071633 | A1* | 3/2016 | Uchida | B21C 1/04 148/550 |
| 2016/0194742 | A1* | 7/2016 | Sekiya | C22F 1/047 174/72 A |
| 2016/0358685 | A1* | 12/2016 | Yoshida | C22C 21/00 |
| 2017/0069403 | A1* | 3/2017 | Yoshida | C22C 21/08 |
| 2017/0194066 | A1* | 7/2017 | Yoshida | H01B 1/023 |
| 2017/0194067 | A1* | 7/2017 | Yoshida | H01B 1/023 |
| 2017/0213619 | A1* | 7/2017 | Sekiya | H01B 7/0045 |
| 2017/0250000 | A1* | 8/2017 | Sekiya | H01B 1/023 |
| 2018/0002792 | A1* | 1/2018 | Yoshida | C22F 1/04 |
| 2018/0114606 | A1* | 4/2018 | Ikeya | H01B 1/023 |

* cited by examiner

CRYSTAL DIRECTION CONTROL OF ALLOYED ALUMINUM WIRE, ALLOYED ALUMINUM ELECTRIC WIRE, AND WIRE HARNESS USING SAME

CROSS-REFERENCE TO RELATED APPLICATIONS

This application is based upon and claims the benefit of priority from the prior Japanese Patent Application No. 2016-209004, filed on Oct. 25, 2016, the entire contents of which are incorporated herein by reference.

BACKGROUND OF THE INVENTION

1. Field of the Invention

The present invention relates to an aluminum wire, and to an aluminum electric wire and a wire harness that use the aluminum wire. Specifically, the present invention relates to an aluminum wire having excellent strength and elongation properties, and to an aluminum electric wire and a wire harness that use the aluminum wire.

2. Description of the Related Art

Recently, with the growing demand for weight reduction in automobiles, the installation of aluminum electric wires in vehicles is becoming increasingly common. In order to achieve further expansion of this type of installation in vehicles, these aluminum electric wires require superior strength and elongation, while maintaining a high level of conductivity. Further, in recent years, wiring locations containing aluminum electric wires continue to increase in the interiors of automobiles, and because the proportion of wiring formed from aluminum electric wires continues to increase, there are growing demands for reductions in the diameter and weight of aluminum electric wires.

When the diameter of an aluminum electric wire is reduced, the load resistance of the electric wire decreases. However, in the production steps or assembly steps for a wire harness, the terminal junction portion of the electric wire terminal and the electric wire itself are subjected to impacts, and the electric wire material must have sufficiently high levels of strength and elongation to withstand those impacts.

In order to satisfy these types of demands, prescribed amounts of other elements have conventionally been added to the aluminum. For example, JP 2015-124409 A discloses an aluminum alloy wire material containing prescribed amounts of Si, Mg, Cu and Zn, with the remainder being Al and unavoidable impurities. The document also discloses that the tensile strength following a solution heat treatment at 550° C. and then an aging treatment at 170° C.×8 hours is 400 MPa or greater, and that when a heat resistance test of 150° C.×1,000 hours is performed following the aging treatment, the tensile strength is still 370 MPa or greater. Further, the document also discloses that the aluminum alloy wire material has a degree of orientation of the (111) plane in a cross-sectional X-ray diffraction of 0.5 or greater.

Further, JP 2016-108612 A discloses an aluminum alloy wire material having a composition containing prescribed amounts of Mg, Si, Fe, Ti, B, Cu, Ag, Au, Mn, Cr, Zr, Hf, V, Sc, Sn, Co and Ni, with the remainder being Al and unavoidable impurities. Further, the document also discloses that the surface area proportion of those regions in which the angle between the longitudinal direction of the aluminum alloy wire material and the <111> direction of the crystals is 20° or less exceeds 65%, and that the dispersion density of Mg—Si-based compounds within the aluminum alloy wire material is not more than $3\times10^{-3}$ particles/$\mu^2$.

BRIEF SUMMARY OF THE INVENTION

However, in JP 2015-124409 A and JP 2016-108612 A, although the strength of the aluminum electric wire is enhanced by appropriate selection and alloying of the additive elements, a drawback arises in that the elongation deteriorates.

The present invention has been developed in light of the above problems associated with the conventional technology. Objects of the present invention are to provide an aluminum wire having improved strength and elongation, and to provide an aluminum electric wire and a wire harness that use the aluminum wire.

An aluminum wire according to a first aspect of the present invention has a composition containing at least one element selected from the group consisting of Fe: 0 to 2.0% by mass, Mg: 0 to 1.0% by mass, Zr: 0 to 0.5% by mass, Si: 0 to 1.2% by mass, and Ni: 0 to 0.3% by mass, with the remainder being composed of aluminum and unavoidable impurities. In a cross section perpendicular to the longitudinal direction of the aluminum wire, the surface area proportion of component crystals for which the angle between the longitudinal direction and the <111> direction of the crystal is 10° or less, relative to the total surface area of the cross section, is 50% or greater, and the surface area proportion of component crystals for which the angle between the longitudinal direction and the <111> direction of the crystal is 20° or less, relative to the total surface area of the cross section, is 85% or greater.

An aluminum wire according to a second aspect of the present invention relates to the aluminum wire according to the first aspect, wherein the 0.2% proof stress is 30 MPa or greater, the elongation is 10% or greater, and the conductivity is 50% IACS or greater.

An aluminum electric wire according to a third aspect of the present invention includes the aluminum wire according to the first or second aspect, and an insulator layer that coats the outer periphery of the aluminum wire.

A wire harness according to a fourth aspect of the present invention includes the aluminum electric wire according to the third aspect.

The present invention is able to provide an aluminum wire having improved strength and elongation, and an aluminum electric wire and a wire harness that use the aluminum wire.

DETAILED DESCRIPTION OF THE INVENTION

Figure 1:
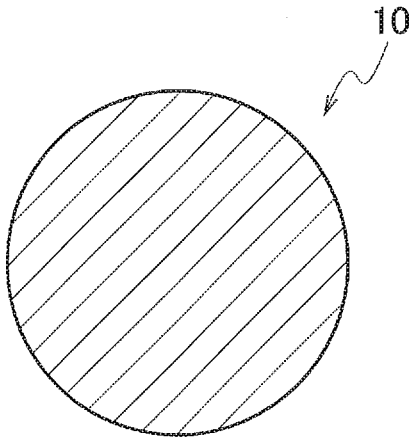
FIG. 1 is a schematic cross-sectional view illustrating one example of an aluminum wire according to an embodiment of the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for an embodiment of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

[Aluminum Wire]

Alloys from heat treatment systems (precipitation systems) are generally strengthened by using a solution heat treatment and an aging process to precipitate very fine particles in the alloy matrix while maintaining conformity. Here, alloy strengthening means, at the microscopic level, increasing the barriers to dislocation motion within the alloy by interspersing precipitates within the alloy, and a drawback of this strengthening is an accompanying deterioration in the ductility. Accordingly, as long as material strengthening is sought by precipitation strengthening, the ductility characteristics prior to the precipitation generated by aging must be sacrificed to no small extent. Accordingly, how to achieve strengthening while suppressing any deterioration in the ductility characteristics of the alloy to a minimum is a considerable challenge.

The aluminum wire according to the present embodiment combines high levels of strength and elongation, which are achieved by subjecting the wire material to a series of thermomechanical treatment processes to control the crystal orientation. As illustrated in FIG. 1, an aluminum wire 10 according to the present embodiment is formed from an aluminum alloy containing at least one element selected from the group consisting of Fe: 0 to 2.0% by mass, Mg: 0 to 1.0% by mass, Zr: 0 to 0.5% by mass, Si: 0 to 1.2% by mass, and Ni: 0 to 0.3% by mass, with the remainder being aluminum and unavoidable impurities.

The aluminum used as the base material in the aluminum wire 10 is preferably a pure aluminum with a purity of at least 99.7% by mass. In other words, among the various aluminum base metals prescribed in JIS H2102 (aluminum base metals), those having a purity of A199.70 or higher can be used favorably. Specific examples include A199.70, A199.94, A199.97, A199.98, A199.99, A199.990 and A199.995, all of which have a purity of at least 99.70% by mass. In this manner, the aluminum base metal in the present embodiment is not restricted to very expensive high-purity aluminum such as A199.995, and more reasonably priced aluminum base metals having a purity of at least 99.7% by mass can also be used.

Iron (Fe) is an element that has a low solid solubility limit, yields strengthening mainly by the mechanism of precipitation strengthening, and can improve the strength of the aluminum wire while suppressing any deterioration in the conductivity to a minimum. However, although the iron within the aluminum contributes to enhanced strength, if the iron content exceeds 2.0% by mass, then crystallized products with aluminum tend to cause a marked deterioration in the ductility and toughness of the aluminum wire. Accordingly, iron is preferably included in the aluminum alloy in an amount within a range from 0 to 2.0% by mass, and more preferably from 0.1 to 1.2% by mass.

Magnesium (Mg) is an element which, by precipitation in the aluminum matrix, can improve the strength of the aluminum wire while suppressing any deterioration in the conductivity to a minimum. However, if the magnesium content exceeds 1.0% by mass, then the conductivity, ductility and toughness of the obtained aluminum alloy tend to deteriorate. Accordingly, magnesium is preferably included in the aluminum alloy in an amount within a range from 0 to 1.0% by mass, and more preferably from 0.25 to 0.6% by mass.

Zirconium (Zr) is an element that is useful for improving the heat resistance, and can improve the strength of an alloy by solid solution strengthening, and precipitation-dispersion strengthening. However, if the zirconium content exceeds 0.5% by mass, then the toughness tends to deteriorate and the wire drawability worsens. Accordingly, zirconium is preferably included in the aluminum alloy in an amount within a range from 0 to 0.5% by mass, and more preferably from 0.001 to 0.4% by mass.

Silicon (Si) can improve the strength of the aluminum wire by solid solution strengthening, and precipitation-dispersion strengthening. However, if the silicon content exceeds 1.2% by mass, then the toughness tends to deteriorate and the wire drawability worsens. Accordingly, silicon is preferably included in the aluminum alloy in an amount within a range from 0 to 1.2% by mass, and more preferably from 0.4 to 0.6% by mass.

Nickel (Ni) can improve the strength of the aluminum wire by precipitation strengthening and by increasing the precipitation density. Even if the nickel content is increased, any reduction in the conductivity of the obtained aluminum alloy is minor, but if the nickel content exceeds 0.3% by mass, then the ductility and toughness tend to deteriorate. Accordingly, nickel is preferably included in the aluminum alloy in an amount within a range from 0 to 0.3% by mass, and more preferably from 0.01 to 0.2% by mass.

The aluminum wire 10 according to the present embodiment may contain at least one element selected from the group consisting of Fe, Mg, Zr, Si and Ni as an additive element, and may also contain at least one of Ti and V. Specifically, the aluminum wire 10 according to the present embodiment may be formed from an aluminum alloy containing at least one element selected from the group consisting of Fe: 0 to 2.0% by mass, Mg: 0 to 1.0% by mass, Zr: 0 to 0.5% by mass, Si: 0 to 1.2% by mass, Ni: 0 to 0.3% by mass, Ti: 0.002 to 0.09% by mass, and V: 0.002 to 0.09% by mass, with the remainder being aluminum and unavoidable impurities.

Titanium (Ti) is an element that has an effect of refining the crystal structures of ingots. When the crystal structures of ingots are large, there is an increased possibility of ingot cracking or wire breakage during rolling or wire drawing, resulting in a worsening of productivity. If the titanium content is less than 0.002% by mass, then the refining effect tends not to manifest satisfactorily, whereas if the titanium content exceeds 0.09% by mass, the conductivity tends to deteriorate. Accordingly, titanium is preferably included in the aluminum alloy in an amount within a range from 0.002 to 0.09% by mass.

Vanadium (V) is an element that has an effect of refining the crystal structures of ingots. When the crystal structures of ingots are large, there is an increased possibility of ingot cracking or wire breakage during rolling or wire drawing, resulting in a worsening of productivity. If the vanadium content is less than 0.002% by mass, then the refining effect tends not to manifest satisfactorily, whereas if the vanadium content exceeds 0.09% by mass, the conductivity tends to deteriorate. Accordingly, vanadium is preferably included in the aluminum alloy in an amount within a range from 0.002 to 0.09% by mass.

Examples of the unavoidable impurities that may be incorporated in the aluminum alloy that constitutes the aluminum wire 10 include copper (Cu), gallium (Ga), zinc (Zn), boron (B), manganese (Mn), lead (Pb), calcium (Ca) and cobalt (Co). These elements are incorporated in unavoidable amounts that do not impair the effects of the present embodiment, and do not significantly affect the properties of the aluminum wire of the present embodiment. Further, elements already contained within the pure aluminum base metal are also included within these unavoidable impurities. The total amount of these unavoidable impurities within the aluminum alloy is preferably not more than 0.15% by mass, and more preferably 0.12% by mass or less.

As described above, the aluminum wire 10 of the present embodiment is formed from an aluminum alloy containing, for example, Fe and Mg as additive elements, with the remainder being aluminum and unavoidable impurities. Further, the aluminum wire 10 may be formed from an aluminum alloy containing, for example, Fe, Mg and Zr as additive elements, with the remainder being aluminum and unavoidable impurities. Moreover, the aluminum wire 10 may be formed from an aluminum alloy containing, for example, Mg, Si and Ni as additive elements, with the remainder being aluminum and unavoidable impurities. In those cases where the amounts added of Fe, Mg, Zr, Si and Ni are 0% by mass, the aluminum wire 10 is formed from an aluminum containing unavoidable impurities. In the present embodiment, in order to achieve a combination of high levels of strength and elongation, the crystal orientation of the metals that constitute the aluminum wire 10 is controlled. Specifically, in a cross section perpendicular to the longitudinal direction of the aluminum wire 10, the surface area proportion of component crystals for which the angle between the longitudinal direction and the <111> direction of the crystal is 10° or less, relative to the total surface area of the cross section, is 50% or greater. Furthermore, in a cross section perpendicular to the longitudinal direction of the aluminum wire 10, the surface area proportion of component crystals for which the angle between the longitudinal direction and the <111> direction of the crystal is 20° or less, relative to the total surface area of the cross section, is 85% or greater. In this description, the surface area proportion of component crystals for which the angle between the longitudinal direction and the <111> direction of the crystal is 10° or less, relative to the total surface area of the cross section, is termed the "<111> degree of alignment (within 10°)". Further, the surface area proportion of component crystals for which the angle between the longitudinal direction and the <111> direction of the crystal is 20° or less, relative to the total surface area of the cross section, is termed the "<111> degree of alignment (within 20°)".

Figure 2:
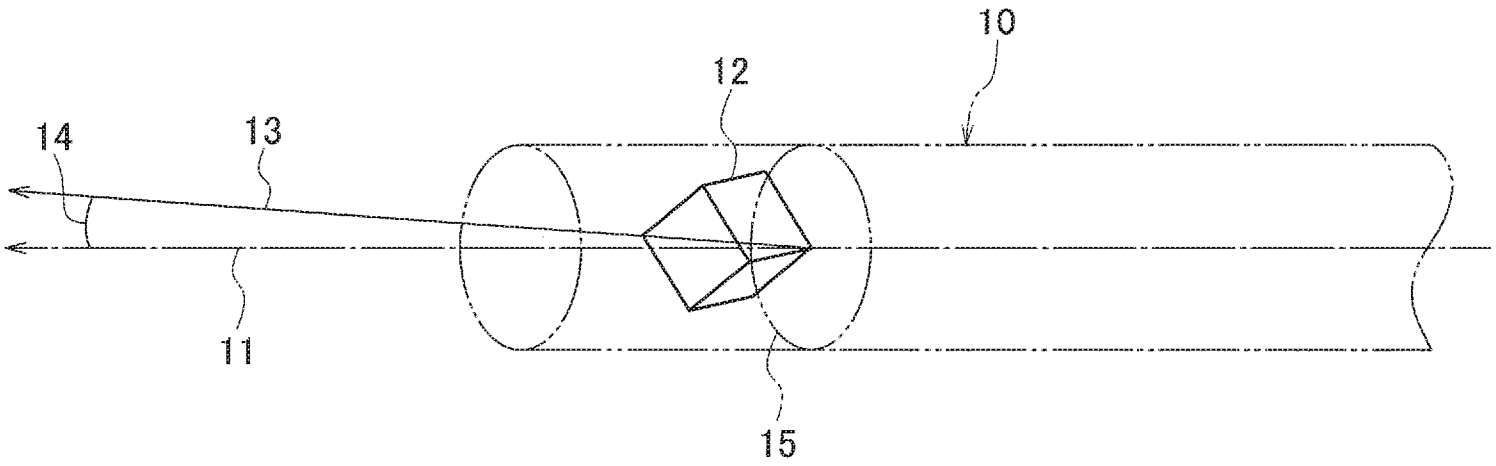
FIG. 2 is a schematic illustration explaining the angle formed between the longitudinal direction of an aluminum wire, and the <111> direction of a crystal of aluminum that constitutes the aluminum wire.

As illustrated in FIG. 2, the aluminum wire 10 contains aluminum having a face-centered cubic structure as the main component, and therefore the unit lattice of the metal that constitutes the aluminum wire 10 is cubic. The "angle between the longitudinal direction of the aluminum wire 10 and the <111> direction of a crystal" describes the angle 14 between the longitudinal direction 11 of the aluminum wire 10, and the <111> direction 13 of the cubic metal crystal 12. Further, <111> represents all the crystal axes equivalent to [111].

The orientations of metal crystals in a cross section 15 perpendicular to the longitudinal direction of the aluminum wire 10 are measured. In these measurements, the proportion calculated as the surface area of component crystals for which the angle between the longitudinal direction 11 of the aluminum wire 10 and the <111> direction 13 of the metal crystal 12 is 10° or less, divided by the total surface area of the cross section 15, is preferably 50% or greater. Further, the proportion calculated as the surface area of component crystals for which the angle between the longitudinal direction 11 of the aluminum wire 10 and the <111> direction 13 of the metal crystal 12 is 20° or less, divided by the total surface area of the cross section 15, is preferably 85% or greater. By ensuring that the <111> degree of alignment (within 10°) is 50% or greater, and the <111> degree of alignment (within 20°) is 85% or greater, high levels of strength and elongation can be achieved even when the diameter of the aluminum wire 10 is reduced, meaning the reliability of the aluminum wire in a vehicle-mounted environment can be enhanced.

The mechanism that enables a combination of favorable strength and elongation for the aluminum wire 10 to be achieved by ensuring that the <111> degree of alignment (within 10°) and the <111> degree of alignment (within 20°) satisfy the above numerical values is not entirely clear. However, by ensuring that the <111> degree of alignment (within 10°) and the <111> degree of alignment (within 20°) satisfy the above numerical values, an increase in strength can be achieved due to an increase in the Taylor factor relative to tensile deformation, namely an increase in the deformation resistance. Further, when the <111> degree of alignment (within 10°) and the <111> degree of alignment (within 20°) satisfy the above numerical values, the tensile deformation direction and the crystal deformation direction approach one another for the majority of the metal crystals that constitute the aluminum wire, resulting in a lengthening of the crystal deformation distance. This distance is also dependent on the crystal grain size, but a lengthening of this deformation distance enables an improvement in the ductility. However, it should be noted that the technical scope of the present invention is not necessarily limited to embodiments that yield effects through these types of mechanisms.

There are no particular limitations on the final wire diameter of the aluminum wire 10 of the present embodiment. However, in terms of ensuring superior mechanical properties such as strength and elongation, and enabling a reduction in the wire diameter, the final diameter of the aluminum wire 10 is typically within a range from 0.1 mm to 1.0 mm.

Next is a description of a method for producing the aluminum wire according to the present embodiment.

(Casting Step)

First, in those cases where the aluminum wire is composed of an aluminum containing unavoidable impurities, an ingot is produced by melting and casting the aluminum base metal. Further, in those cases where the aluminum wire is composed of an aluminum alloy containing, for example, Fe and Mg, with the remainder being aluminum and unavoidable impurities, an ingot is first produced by melting and casting the Al with the Fe and Mg. In those cases where the aluminum wire is composed of an aluminum alloy containing, for example, Fe, Mg and Zr, with the remainder being aluminum and unavoidable impurities, an ingot is first produced by melting and casting the Al with the Fe, Mg and Zr. Moreover, in those cases where the aluminum wire is composed of an aluminum alloy containing Mg, Si and Ni, with the remainder being aluminum and unavoidable impurities, an ingot is first produced by melting and casting the Al with the Mg, Si and Ni. The ingot may, for example, be formed with a diameter of ø18 mm.

(Rolling Step)

Next, the ingot described above is rolled to obtain an aluminum rough wire rod. By performing this rolling step, the crystal grains in the obtained aluminum rough wire rod can be refined. There are no particular limitations on the method used for the rough rolling of the aluminum ingot, and conventional methods can be used.

The aluminum rough wire rod typically has a cross section that is either circular, or a polygonal shape such as a triangle or square. The size of the cross section of the aluminum rough wire rod in the case where the cross section is circular, is typically a diameter of 5 mm to 30 mm, and preferably 7 mm to 20 mm. In the present embodiment, the diameter of the aluminum rough wire rod can be set to 9.5 mm. This aluminum rough wire rod functions as the raw material for the subsequent solution heat treatment step.

(Solution Heat Treatment Step)

The solution heat treatment step is a step of ensuring that those elements that are not fully melted into the aluminum matrix in the wire material prior to the solution heat treatment are melted and dispersed uniformly into the aluminum matrix, generating a homogenous crystal structure. Accordingly, when the aluminum wire is formed from an aluminum alloy, performing this solution heat treatment step is preferable. There are no particular limitations on the solution heat treatment step, and in one example, the step can be performed by holding the aluminum rough wire rod at a temperature of 500 to 600° C., and then performing rapid cooling by water cooling or the like. This step is suitable for aging-precipitation type aluminum alloys.

(Aging Heat Treatment Step)

The aging heat treatment step is a step of precipitating the elements that were melted into the aluminum matrix in the solution heat treatment step, and is a step performed mainly for strengthening. The aging heat treatment step is performed following the solution heat treatment step, but the wire drawing step and the like described below may sometimes also be performed prior to the aging heat treatment step. Further, in some cases, the aging heat treatment step may be unnecessary.

There are no particular limitations on the aging heat treatment step, and in one example, the step can be performed by holding the aluminum wire at a temperature of 200 to 400° C. for a prescribed time, and then cooling the wire by water cooling or furnace cooling or the like. This step is suitable for aging-precipitation type aluminum alloys.

(Wire Drawing Step)

The wire drawing step is a step of further refining the crystal structure of the aluminum by subjecting the solution heat-treated wire material obtained following the solution heat treatment step, or the aluminum rough wire rod in those cases where the solution heat treatment step is not performed, to wire drawing until the final wire diameter is achieved. A conventional dry wire drawing method or wet wire drawing method can be used as the wire drawing method in this wire drawing step. The drawn wire material obtained in the wire drawing step typically has a circular cross section. The wire diameter ø of the drawn wire material is typically within a range from 0.1 mm to 0.5 mm, and preferably from 0.15 mm to 0.35 mm.

Figure 3A:
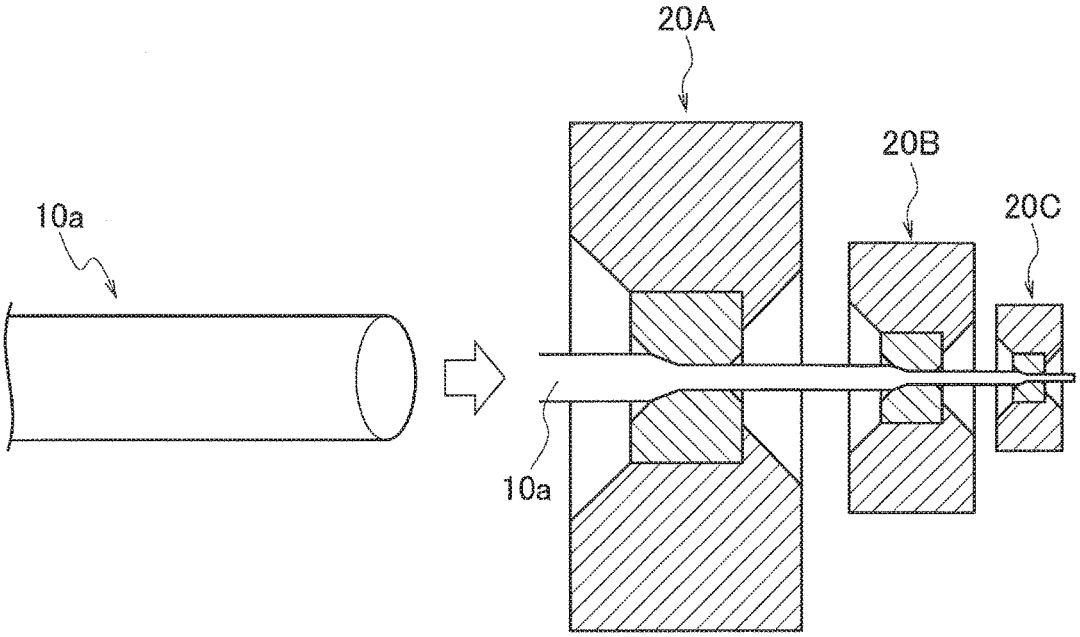
FIG. 3A is a schematic illustration explaining a procedure for reducing the diameter of an aluminum wire using a plurality of dies.

As illustrated in FIG. 3A, when reducing the diameter of the solution heat-treated wire material or the aluminum rough wire rod down to the final diameter, a plurality of dies 20A, 20B and 20C are preferably used to gradually narrow the solution heat-treated wire material or aluminum rough wire rod 10*a*. In this process, the reduction of area for each die is typically set to a value within a range from 5 to 20%.

The reduction of area for the drawn wire material ((cross-sectional area of wire material before wire drawing treatment—cross-sectional area of wire material after wire drawing treatment)/(cross-sectional area of wire material before wire drawing treatment)×100) is preferably within a range from 90 to 99.99%. Further, in the wire drawing step, when reducing the diameter of the solution heat-treated wire material or the aluminum rough wire rod to the final diameter, a heat treatment is preferably not performed. In other words, the wire drawing step is preferably performed at normal temperature. By ensuring that the area of reduction satisfies the above range, and that a heat treatment is not conducted in the wire drawing step, the <111> degree of alignment (within 10°) and the <111> degree of alignment (within 20°) can be adjusted to the numerical values described above.

(Electric Heating Step (Final Heat Treatment))

The electric heating step is a step of subjecting the drawn wire material obtained in the wire drawing step to electric heating, thereby annealing the wire material by Joule heat.

The annealing of this step typically employs continuous annealing in which the annealing is performed while moving the drawn wire material. In the production method of the present embodiment, this continuous annealing is an important process that enables the crystal orientation of the metals to be controlled in the prescribed direction, and the tensile strength and elongation of the aluminum wire to be increased, by performing annealing within an extremely short period of time. The electric heating time of the drawn wire material is preferably extremely short, and for example, is preferably within a range from 0.2 seconds to 2.0 seconds.

Figure 3B:
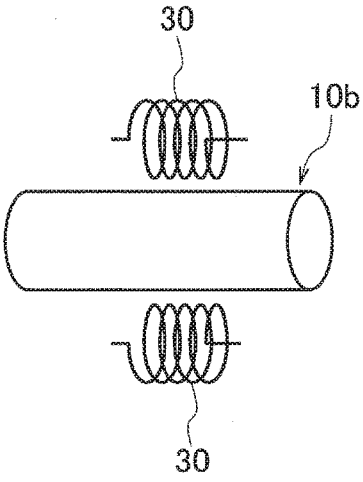
FIG. 3B is a schematic illustration explaining the heating of an aluminum wire following diameter reduction.

A continuous electric heating treatment or the like can be used for the continuous annealing. As illustrated in FIG. 3B, this continuous electric heating treatment is a treatment in which the drawn wire material 10*b* is passed continuously between two electrode rings 30 to cause a current to flow in the drawn wire material 10*b*, thereby heating the drawn wire material 10*b* by Joule heat, with this Joule heat causing continuous annealing of the drawn wire material 10*b*.

The annealed drawn wire material obtained following annealing of the drawn wire material has substantially the same composition as the drawn wire material, but some or all of the internal processing strain has been removed, thereby restoring the ductility, and recrystallized grains have also formed, imparting an appropriate level of flexibility.

In this manner, in the method for producing an aluminum wire according to the present embodiment, in those cases where the aluminum contains additive elements, processing is conducted in a sequence composed of the solution heat treatment step, aging heat treatment step, wire drawing step and electric heating step, or a sequence composed of the solution heat treatment step, wire drawing step, aging heat treatment step and electric heating step, or a sequence composed of the solution heat treatment step, wire drawing step, aging heat treatment step, wire drawing step and electric heating step. Further, in those cases where the aluminum contains no additive elements, processing is conducted in a sequence composed of the wire drawing step and the electric heating step. In other words, in the method for producing an aluminum wire according to the present embodiment, the wire drawing step and the electric heating step are performed after the solution heat treatment step. By conducting processing in this sequence, the aluminum wire is able to develop appropriate levels of strength and elongation.

As described above, the aluminum wire 10 of the present embodiment has a composition containing at least one element selected from the group consisting of Fe: 0 to 2.0% by mass, Mg: 0 to 1.0% by mass, Zr: 0 to 0.5% by mass, Si: 0 to 1.2% by mass, and Ni: 0 to 0.3% by mass, with the remainder being composed of aluminum and unavoidable impurities. In a cross section 15 perpendicular to the longitudinal direction 11 of the aluminum wire 10, the surface area proportion of component crystals for which the angle 14 between the longitudinal direction 11 and the <111> direction 13 of the crystal is 10° or less, relative to the total surface area of the cross section 15, is 50% or greater, and the surface area proportion of component crystals for which the angle 14 between the longitudinal direction 11 and the <111> direction 13 of the crystal is 20° or less, relative to the total surface area of the cross section 15, is 85% or greater. In this manner, by using the thermomechanical processing of the wire material to control the crystal orientation of the metals, the deformation resistance of the metal crystals of the aluminum wire 10 can be increased, and the crystal deformation distance can be lengthened, meaning a combination of high strength and high ductility can be achieved for the aluminum wire 10. This combination of high strength and high ductility can contribute to an expansion in the installation of the types of aluminum electric wires described below within vehicles, and also contribute to weight reductions for wire harnesses.

The aluminum wire 10 of the present embodiment preferably has a 0.2% proof stress of 30 MPa or greater, an elongation of 10% or greater, and a conductivity of 50% IACS or greater. By ensuring that the 0.2% proof stress and the elongation of the aluminum wire 10 have these types of values, the mechanical strength is improved, and wire breakages during or following installation on a vehicle become less likely. Accordingly, the wire can be used in regions where repeated bending occurs, such as around the door hinges of automobiles, and in regions exposed to vibration, such as the engine room. The 0.2% proof stress and elongation (breaking elongation) at room temperature can be measured in accordance with JIS 22241 (Metallic materials—tensile testing methods). Further, the conductivity can be measured in accordance with JIS H0505 (Measuring methods for electrical resistivity and conductivity of nonferrous materials).

[Aluminum Electric Wire]

Figure 4:
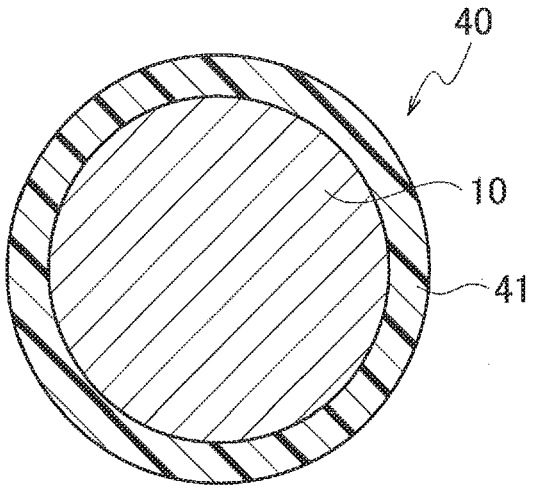
FIG. 4 is a schematic cross-sectional view illustrating one example of an aluminum electric wire according to an embodiment of the present invention.

Next is a description of an aluminum electric wire according to an embodiment of the present invention. As illustrated in FIG. 4, an aluminum electric wire 40 according to this embodiment includes the aluminum wire 10, and an insulator layer 41, which functions as a coating material that coats the outer periphery of the aluminum wire 10.

In the aluminum electric wire 40 of the present embodiment, a single wire composed of one aluminum wire 10, or a stranded wire composed of a plurality of aluminum wires 10 twisted together, may be used as the conductor. The stranded wire may have any of various configurations, including a concentric twisted wire configuration in which wires are twisted concentrically around one or a plurality of central wires, an assembled twisted wire configuration in which a plurality of wires are twisted together in the same direction, and a compound twisted wire configuration in which a plurality of assembled twisted wires are twisted concentrically.

There are no particular limitations on the material or the thickness of the insulator layer 41 that coats the outer periphery of the aluminum electric wire 40, provided satisfactory electrical insulation of the aluminum electric wire 40 can be ensured. Examples of resin materials that may be used for forming the insulator layer 41 include polyvinyl chloride, heat-resistant polyvinyl chloride, crosslinked polyvinyl chloride, polyethylene, crosslinked polyethylene, foamed polyethylene, crosslinked foamed polyethylene, chlorinated polyethylene, polypropylene, polyamide (nylon), polyvinylidene fluoride, ethylene-tetrafluoroethylene copolymers, tetrafluoroethylene-hexafluoropropylene copolymers, polytetrafluoroethylene, perfluoroalkoxy alkanes, natural rubbers, chloroprene rubber, butyl rubber, ethylene-propylene rubber, chlorosulfonated polyethylene rubber and silicone rubbers. These materials may be used individually, or a combination of two or more materials may be used.

[Cable]

Figure 5:
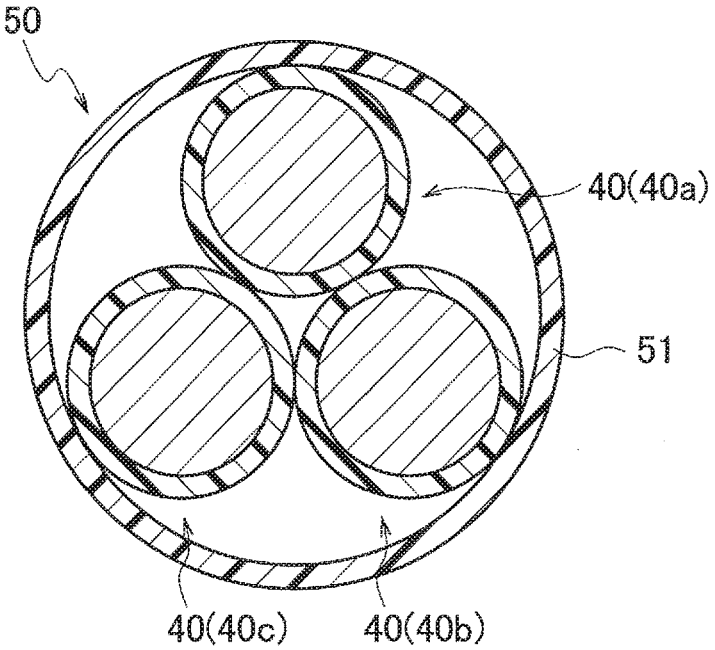
FIG. 5 is a schematic cross-sectional view illustrating one example of a cable according to an embodiment of the present invention.

Next is a description of a cable according to an embodiment of the present invention. As illustrated in FIG. 5, a cable 50 according to this embodiment includes a plurality of bundled aluminum electric wires 40 (40*a*, 40*b*, 40*c*), and a sheath 51, which functions as a coating material that coats the outer periphery of the bundled plurality of aluminum electric wires 40. There are no particular limitations on the material of the sheath 51, and the same types of materials as those described above for the insulator layer 41 can be used. The aluminum electric wire 40 and the cable 50 described above can be used favorably in an automobile wire harness that requires high levels of strength, durability and conductivity.

The present invention is described below in further detail using a series of examples, but the present invention is in no way limited by these examples.

[Production of Aluminum Wires]

Using JIS H2102 A199.7, the aluminum samples and aluminum alloys shown in Table 1 were obtained by selectively adding prescribed amounts of iron, magnesium, zirconium, silicon and nickel. Each of these metals was melted using normal methods, and then subjected to continuous casting and rolling to prepare an aluminum rough wire rod with a diameter of 9.5 mm.

Next, this aluminum rough wire rod was heated at 500° C. for 30 minutes, and was then cooled in water, thus forming a wire material that had undergone a solution heat treatment (a solution heat-treated wire material). This solution heat-treated wire material was then subjected to wire drawing using a continuous wire drawing device to obtain a drawn wire material having a final wire diameter ø of 0.32 mm. The reduction of area for the drawn wire material of each example is shown in Table 1. Examples 5 to 8 and Comparative Examples 4 to 7 were also subjected to an aging heat treatment under prescribed conditions following the solution heat treatment.

The drawn wire material of each example was then subjected to a final heat treatment shown in Table 1 to obtain an aluminum wire. Specifically, in Examples 1 to 8 and Comparative Examples 1, 4 and 7, the final heat treatment was performed by electrically heating the drawn wire material at 12 V for 0.6 seconds. Further, in Comparative Examples 2, 3, 5 and 6, the final heat treatment was performed by using a batch furnace to heat the drawn wire material for one hour at a temperature of 250° C., 300° C., 285° C. or 280° C. respectively.

[Evaluations]

(Measurement of Crystal Structure Orientation)

For each of the aluminum wires obtained in Examples 1 to 8 and Comparative Examples 1 to 7, a cross section perpendicular to the longitudinal direction of the aluminum wire was measured for crystal structure orientation using the electron back-scattering diffraction method (EBSD). Then, by calculating the surface area of the component crystals for which the angle between the longitudinal direction of the aluminum wire and the <111> direction of the metal crystal was 10° or less, and dividing this surface area by the total cross-sectional area of the aluminum wire, the <111> degree of alignment (within 10°) was determined. In a similar manner, by calculating the surface area of the component crystals for which the angle between the longitudinal direction of the aluminum wire and the <111> direction of the metal crystal was 20° or less, and dividing this surface area by the total cross-sectional area of the aluminum wire, the <111> degree of alignment (within 20°) was determined. The results obtained are also shown in Table 1.

(Measurement of Tensile Strength and Breaking Elongation)

Each of the aluminum wires obtained in Examples 1 to 8 and Comparative Examples 1 to 7 was measured for room-temperature tensile strength and breaking elongation in accordance with JIS 22241. These measurement results are also shown in Table 1.

TABLE 1

| No. | | Composition (% by mass) Fe | Mg | Zr | Si | Ni | Reduction of area (%) | Final heat treatment | <111> degree of alignment (within 10°) | <111> degree of alignment (within 20°) | Tensile strength (MPa) | Breaking elongation (%) |
|---|---|---|---|---|---|---|---|---|---|---|---|---|
| Example | 1 | — | — | — | — | — | 99.99 | electric | 64 | 89 | 90 | 24 |
| | 2 | — | — | — | — | — | 90.0 | electric | 50 | 85 | 80 | 25 |
| | 3 | 0.5 | 0.3 | — | — | — | 98 | electric | 58 | 88 | 150 | 24 |
| | 4 | 0.6 | 0.3 | — | — | — | 92 | electric | 51 | 86 | 130 | 24 |
| | 5 | — | 0.5 | — | 0.5 | 0.15 | 99 | electric | 54 | 86 | 280 | 15 |
| | 6 | — | 0.5 | — | 0.5 | 0.15 | 95 | electric | 52 | 85 | 260 | 15 |
| | 7 | 0.1 | — | 0.1 | — | — | 99 | electric | 54 | 88 | 110 | 25 |
| | 8 | 0.1 | — | 0.1 | — | — | 95 | electric | 51 | 87 | 100 | 25 |
| Comparative Example | 1 | — | — | — | — | — | 89 | electric | 48 | 80 | 75 | 25 |
| | 2 | — | — | — | — | — | 90.0 | batch | 25 | 40 | 70 | 26 |
| | 3 | 0.6 | 0.3 | — | — | — | 98 | batch | 30 | 42 | 125 | 22 |
| | 4 | — | 0.5 | — | 0.5 | 0.15 | 88 | electric | 35 | 50 | 255 | 12 |
| | 5 | — | 0.5 | — | 0.5 | 0.15 | 88 | batch | 28 | 39 | 245 | 13 |
| | 6 | 0.1 | — | 0.1 | — | — | 88 | batch | 30 | 50 | 90 | 22 |
| | 7 | 0.1 | — | 0.1 | — | — | 88 | electric | 38 | 60 | 95 | 23 |

As shown in Table 1, in the aluminum wires of Examples 1 to 8, the <111> degree of alignment (within 10°) was 50% or greater, and the <111> degree of alignment (within 20°) was 85% or greater. In contrast, in the aluminum wires of Comparative Examples 1 to 7, the <111> degree of alignment (within 10°) was less than 50% and the <111> degree of alignment (within 20°) was less than 85%. Accordingly, it is evident that annealing of the drawn wire material is preferably conducted by electric heating annealing for an extremely short period of time.

Figure 6:
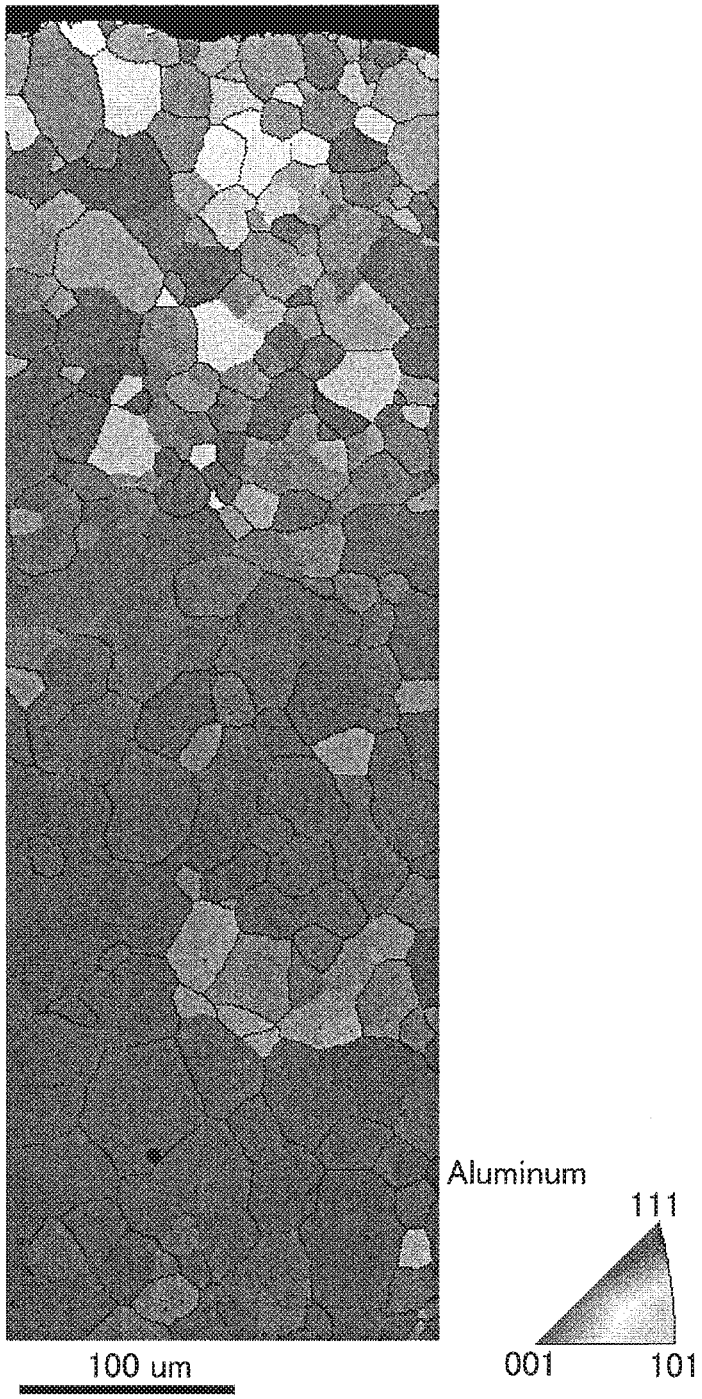
FIG. 6 is a diagram showing the results of using an electron back-scattering diffraction method (EBSD) to measure the orientation indices of metal structures within a cross section of an aluminum wire in Example 2.

FIG. 6 shows the results of using the electron back-scattering diffraction method (EBSD) to measure the orientation indices of metal structures within a cross section of the aluminum wire of Example 2. The crystal orientations in FIG. 6 are indicated relative to the fundamental triangle in the figure. As illustrated in FIG. 6, it is evident that by setting the area of reduction to 90% or higher, and performing electric heating annealing for an extremely short period of time, the crystals are oriented in the <111> direction.

Further, based on Table 1, it is clear that the aluminum wires of Examples 1 to 8 exhibit improvements in the elongation and increased strength of 20 to 30 MPa compared with the aluminum wires of Comparative Examples 1 to 7. Accordingly, it is evident that by controlling the crystal orientation of the metals that constitute the aluminum wire in a prescribed direction, a combination of superior strength and elongation can be achieved.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

DESCRIPTION OF THE SYMBOLS

10: Aluminum wire
11: Longitudinal direction
12: Crystal
13: <111> direction of crystal
14: Angle
15: Cross section
40: Aluminum electric wire
41: Insulator layer

The invention claimed is:

1. An aluminum wire having a composition comprising at least one element selected from the group consisting of Fe: 0 to 2.0% by mass, Mg: 0 to 1.0% by mass, Zr: 0 to 0.5% by mass, Si: 0 to 1.2% by mass, and Ni: 0 to 0.3% by mass, with a remainder being composed of aluminum and unavoidable impurities, wherein the aluminum is formed of a plurality of aluminum crystals having a face-centered cubic structure, and in a cross section perpendicular to a longitudinal direction of the aluminum wire, a surface area of the aluminum crystals in the cross section which form an angle of 10° or less between the longitudinal direction of the aluminum wire and a <111> direction of each of the aluminum crystals and a total surface area of the cross section of the aluminum wire is 50% or greater, and a surface area of the aluminum crystals in the cross section which form an angle of 20° or less between the longitudinal direction of the aluminum wire and the <111> direction of each of the aluminum crystals and the total surface area of the cross section of the aluminum wire is 85% or greater.

2. The aluminum wire according to claim 1, having a 0.2% proof stress of 30 MPa or greater, an elongation of 10% or greater, and a conductivity of 50% IACS or greater.

3. An aluminum electric wire comprising:

the aluminum wire according to claim 1, and an insulator layer that coats a periphery of the aluminum wire.

4. A wire harness comprising the aluminum electric wire according to claim 3.

* * * * *